US008893996B1

(12) United States Patent
Braunschweig

(10) Patent No.: US 8,893,996 B1
(45) Date of Patent: Nov. 25, 2014

(54) MILL

(76) Inventor: Nathan Braunschweig, Lomira, WI (US)

( * ) Notice: Subject to any disclaimer, the term of this patent is extended or adjusted under 35 U.S.C. 154(b) by 460 days.

(21) Appl. No.: 13/241,484

(22) Filed: Sep. 23, 2011

Related U.S. Application Data

(60) Provisional application No. 61/385,640, filed on Sep. 23, 2010.

(51) Int. Cl.
*B02C 19/00* (2006.01)

(52) U.S. Cl.
USPC ..... 241/248; 241/260

(58) Field of Classification Search
USPC ..... 241/248, 260, 260.1
See application file for complete search history.

(56) References Cited

U.S. PATENT DOCUMENTS

| | | | | |
|---|---|---|---|---|
| 5,533 | A | 4/1848 | Norton | |
| 587,641 | A * | 8/1897 | Brown | 241/79.2 |
| 1,074,844 | A | 10/1913 | Dellinger | |
| 1,155,353 | A * | 10/1915 | Haldeman | 241/248 |
| 1,224,933 | A | 5/1917 | Jordan | |
| 2,098,480 | A | 11/1937 | Ammon | |
| 2,539,775 | A | 1/1951 | Gordon | |
| 2,560,972 | A | 7/1951 | Martin | |
| 3,082,965 | A | 3/1963 | Decker et al. | |
| 3,880,367 | A | 4/1975 | Grover | |
| 4,422,578 | A | 12/1983 | Scott | |
| 5,511,731 | A | 4/1996 | Schmidt | |
| 5,673,862 | A | 10/1997 | Wingler | |
| 6,217,442 | B1 | 4/2001 | Schmidt | |
| 6,843,435 | B2 | 1/2005 | Verhoef et al. | |
| 7,118,057 | B2 | 10/2006 | Hao | |
| 7,246,762 | B2 | 7/2007 | VanHouten et al. | |
| 2008/0226784 | A1 | 9/2008 | Matthews | |

* cited by examiner

*Primary Examiner* — Mark Rosenbaum
(74) *Attorney, Agent, or Firm* — Brannen Law Office, LLC

(57) ABSTRACT

The present invention relates to an improved mill, and in particular to an improved mill having a drum with several blades that rotates within a housing having several bars affixed near the bottom of the housing. In one embodiment, the mill has a hopper for introducing feed into the housing and a motor assembly for turning the drum within the housing. Several bars are stationarily fixed within the housing. The drum has several blades spaced remote from a central shaft which are supported by a plurality of discs. Each disc has a plurality of holes there through. The blades have an ear at the end proximal the housing outlet to propel the milled feed from the mill. An internal path is provided wherein the feed is likely to make several passes between the blades and the bars, and is unlikely to short circuit within the mill.

14 Claims, 7 Drawing Sheets

MILL

This U.S. utility patent application claims priority on and the benefit of provisional application 61/385,640 filed Sep. 23, 2010, the entire contents of which are hereby incorporated herein by reference.

BACKGROUND OF THE INVENTION

1. Field of the Invention

The present invention relates to an improved mill, and in particular to an improved mill having a drum with several blades that rotates within a housing having several bars affixed near the bottom of the housing.

2. Description of the Related Art

Mills have been in existence for many years and there are many patents covering some of those designs. Among the designs are:

U.S. Pat. No. 3,880,367 to Grover titled Grain Mill. This patent shows a small compact mill for grinding wheat and other grains having annular grinding stones, one fixed and the other driven, each secured to steel cutting burrs which have their cutting edges substantially in the grinding plane and one of which receives grain through a central opening in the burrs. The grain is cut or chopped by secant or non-radial cutter elements closely facing each other and set for shearing action. These force the grain as it is cut radially outward between annular grinding stones which are secured respectively to the stationary and the driven rotary burr. The driven burr is directly connected to the drive shaft of the motor, the motor being provided with a thrust bearing to oppose the thrust between the chopping and grinding elements. A hopper above the stones supplies the feed and includes a removable bottom sealed to the sides, and is provided with a metering opening to feed grain at controlled rate into a feed channel connected with the inlet through the stationary burr.

U.S. Pat. No. 4,422,578 to Scott is titled Rotary Grain Mill Having Means for Controlling Air and Grain Flow Therethrough, and Method. This patent purports to teach that a much better control of the grind of a rotary mill and much more uniformity of grind of the mill is achieved by better control of air flow through the mill, provided by making the milled product collecting pan of the mill air-tight and regulating the amount of in allowed to escape from the pan. The apparatus of the invention includes a housing in which are mounted two discs in spaced, confronting axial alignment, each disc having extending therefrom toward the other disc concentric rows of teeth. The rows of teeth overlap so that alternating rows of radially spaced, interposed teeth are formed. One of the discs is adapted to be rotated in relation to the other disc and grain to be milled, along with any air flow through the mill, is introduced through an inlet to the area between the discs inwardly of the innermost rows of teeth. An outlet into a substantially air tight collecting pan is provided for the milled material after it passes radially outwardly through the interposed row of teeth. An air control valve in communication with the collecting pan controls air flow out of the collecting pan which, in turn, controls air flow through the mill. Making the innermost row of teeth on the stationary disc, and making them shorter than the other teeth, substantially prevents the throwing of pieces of grain back out through the inlet under low feed condition.

U.S. Pat. No. 5,511,731 to Schmidt is titled Screen Construction for Flour Mills. This patent shows a rotary mill, particularly designed for the milling of flour, includes a screen assembly within which the hammer assembly rotates. It consists of a fine inner cylindrical screen surrounded by a coarse support screen. The cylindrical end edges of the screens are supported in end channels. The intake end of the cylindrical screen is provided with an annular wear plate around the inside thereof and extending two or three inches inwardly to protect the fine screen against heavy wear as the whole grain is entering and beginning to be broken up by the hammer assembly. A lip projects inwardly from the free edge of the wear strip to restrain movement of large particles onto the screen.

U.S. Pat. No. 5,673,862 to Wingler is titled Grain Mill. In this patent, a grain mill is disclosed comprising a heat-dissipating, stainless steel housing that holds a pair of grinding stones, one of which rotates with a shaft turned by an electric motor. The shaft is journaled on self-aligning bearings. The bearings and the housing cooperate to keep heat buildup from the grinding operation low so as not to damage the grain, even at higher grinding speed. As an additional check on mill temperature, a thermometer is included to provide temperature information, and an ammeter is connected to the electrical motor to provide information about the electrical current being drawn when the motor rotates the shaft as an indication of the stress on the shaft. A small door near the exit spout permits a check of the uniformity and size of the ground product. Finally, magnets on the hopper attract metal particles and hold them so that they do not enter the space between the grind stones, where they could damage the stones and become part of the product.

U.S. Pat. No. 6,217,442 to Schmidt is titled Grain Processing Apparatus and Methods. In this patent, a grain processing apparatus is used in one embodiment for debranning grain to remove the bran. In another embodiment, it is used as a mill for milling flour. The processor includes a cylindrical drum with an internal rotor having a set of impeller rods. The grain is loaded into the drum and is withdrawn as debranned kernels or flour as treatment proceeds. Bran removed from the grain is withdrawn through a vacuum discharge at the top of the apparatus. The grain is either discharged through a grain discharge or, where it is to be milled, it is withdrawn through the vacuum discharge as flour. The relatively coarse bran can be separated from the flour using a sifter. The air flow withdrawing the flour from the drum is drawn into the drum at the bottom, through a venturi and a valving arrangement. This cools the inlet air and maintains the temperature of the drum at an acceptable temperature.

While each of these inventions may work well for their intended purposes, each is not without drawbacks.

Thus there exists a need for an improved mill that solves these and other problems.

SUMMARY OF THE INVENTION

The present invention relates to an improved mill, and in particular to an improved mill having a drum with several blades that rotates within a housing having several bars affixed near the bottom of the housing. In one embodiment, the mill has a hopper for introducing feed into the housing and a motor assembly for turning the drum within the housing. Several bars are stationarily fixed within the housing. The drum has several blades spaced remote from a central shaft which are supported by a plurality of discs. Each disc has a plurality of holes there through. The blades have an ear at the end proximal the housing outlet to propel the milled feed from the mill. An internal path is provided wherein the feed is likely to make several passes between the blades and the bars, and is unlikely to short circuit within the mill.

According to one advantage of the present invention, the mill operates at a high rate and is capable of grinding one ton of feed in approximately 15 minutes.

According to another advantage of the present invention, the mill is robust. This is advantageously accomplished by the use of stationary bars and rotating blades.

According to a further advantage of the present invention, the blades and bars cooperate to produce a very fine end product. It has been shown that livestock is able to increase digestion with a finer feed. This results in the use of lesser amounts of feed required for the animals.

According to a still further advantage of the present invention, a defined path is defined through the mill by tabs, discs, and fins on the cover which prevents short circuiting of the feed within the mill.

According to a still further advantage yet of the present invention, the blades have ears proximal the outlet to propel the end product from the mill.

According to a still further advantage yet of the present invention, the mill is customizable per the requirements of the end user.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
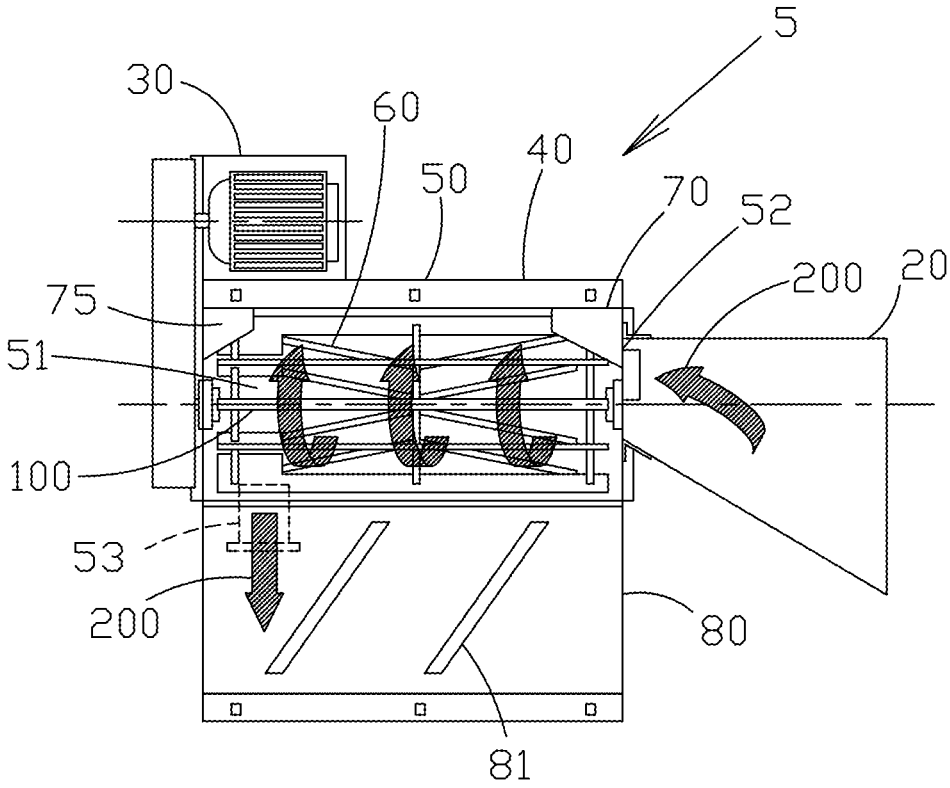
FIG. 1 is a top view of a preferred embodiment of the present invention.
Figure 2:
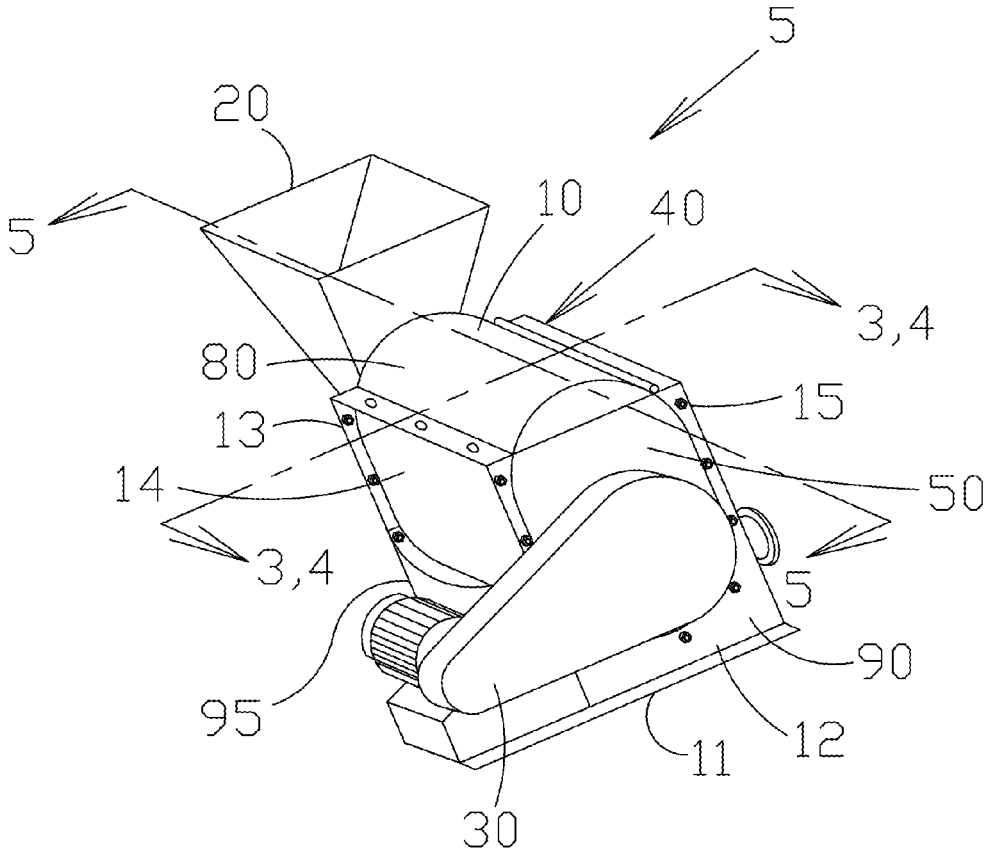
FIG. 2 is a perspective view of the preferred embodiment illustrated in FIG. 1.
Figure 3:
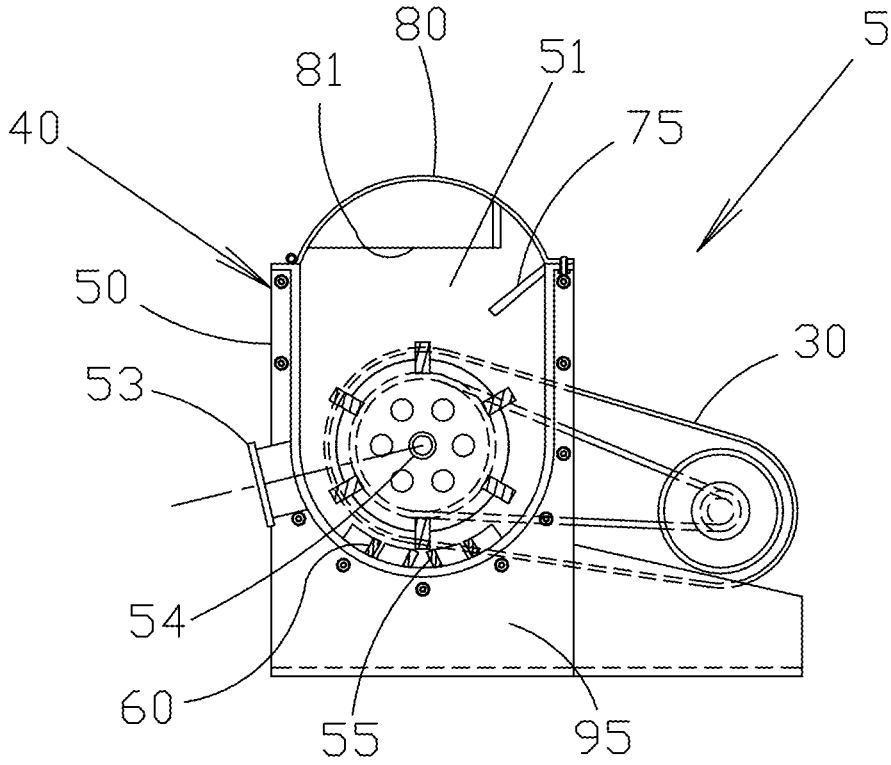
FIG. 3 is a cross-sectional view taken along line 3-3 in FIG. 2.
Figure 4:
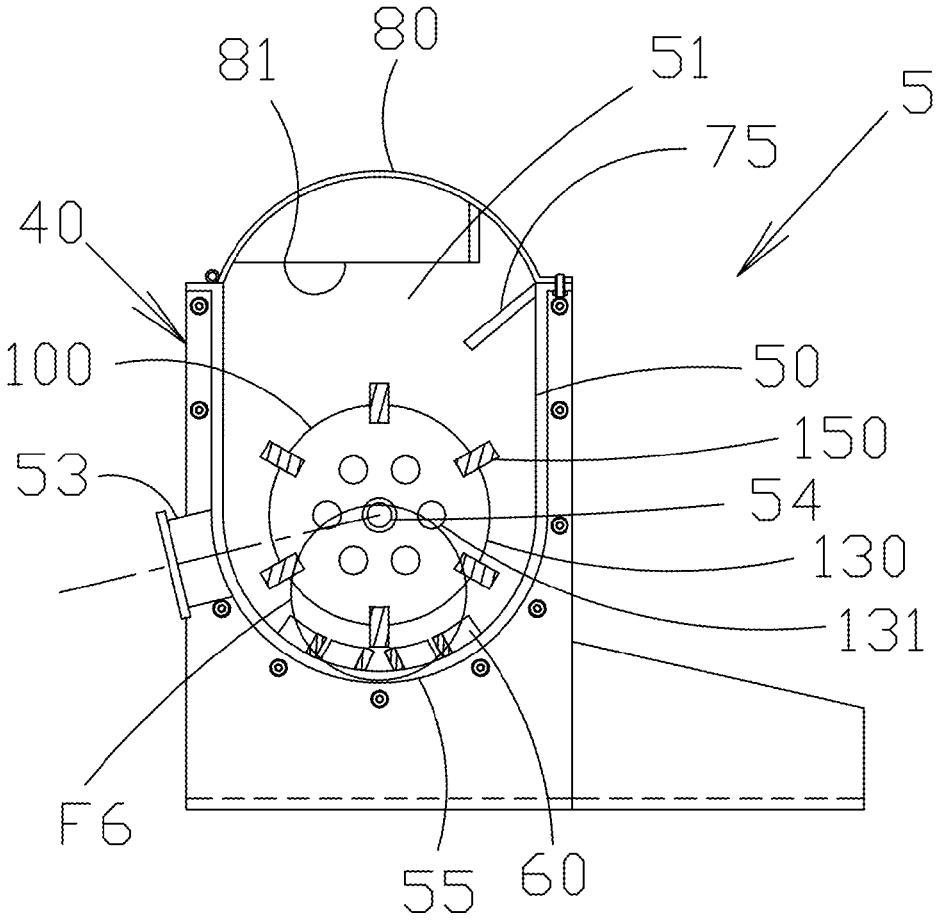
FIG. 4 is a cross-sectional view taken along line 4-4 in FIG. 2 and is similar to FIG. 3 but is illustrated without the motor assembly.
Figure 5:
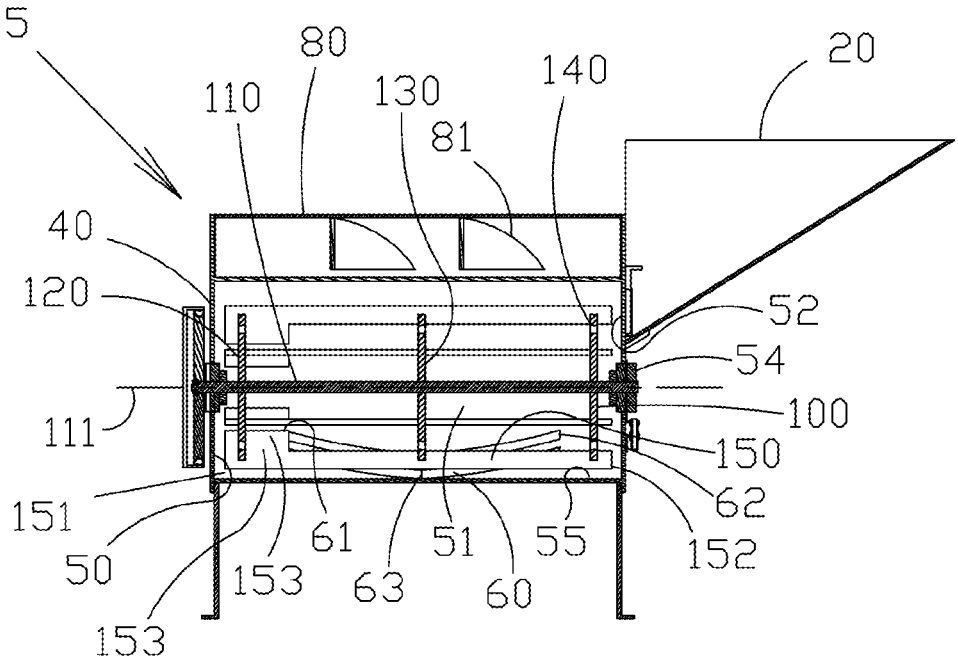
FIG. 5 is a cross-sectional view taken along line 5-5 in FIG. 2.
Figure 6:
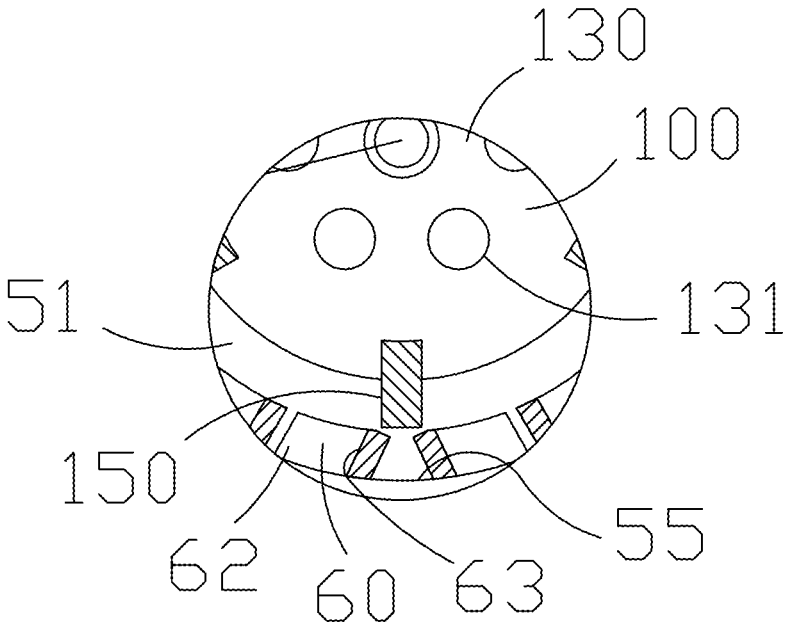
FIG. 6 is a close up view as noted in circle 6 in FIG. 5.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

One preferred embodiment of the mill 5 of the present invention is illustrated in FIGS. 1-7. The mill 5 has a top 10, a bottom 11, sides 12 and 13, a front 14 and a rear 15. A hopper 20 and a motor assembly 30 are provided. It is understood that many types of hoppers 20 and motor assemblies 30 may be used without departing from the broad aspects of the present invention.

A housing 40 is provided having a body 50 and a cover 80. Each of these components is described in detail below.

The body 50 has an interior 51 with a defined inlet 51 and outlet 52. The inlet 52 is preferably located on side 13 of the body 50 near the top 10. It is understood that the inlet can be used in other locations without departing from the broad aspects of the present invention. A gate or the like can cooperate with the hopper 20 and inlet 52 to regulate or control the amount of feed that enters the mill 5 through the hopper 20. The outlet 53 is preferably located at side 12 of the mill 5 near the bottom 11. It is understood that the outlet 53 can be located in other locations without departing from the broad aspects of the present invention. Shaft mounts 54 are further provided.

The body 50 has a bottom 55 on the interior of the interior 51. The bottom 55 preferably has a generally round profile, as viewed best in FIGS. 3 and 4.

There are preferably four bars 60 (which can be made of brass or any other suitably robust material) stationarily fixed to the bottom 55 of the interior 51. The bars can be welded or otherwise secured to the body 50. Each bar 60 has opposed ends 61 and 62 and a middle. The bars 60 preferably have a generally V shaped appearance when viewed from above, as seen in FIG. 1. In this regard, the bars preferably have a bend at their respective middle 63 point. It is further appreciated that the bars 60 are shaped to mate with the contour of the round bottom 55 of the housing 50.

Two tabs 70 and 75 are further provided. The tabs 70 and 75 are preferably affixed to the body 50 at or near the top 10 of the mill 5, and are downwardly angled. Tab 70 is located over the inlet 52 on side 13 of the mill 5. Tab 75 is preferably located at side 12 of the mill 5.

A cover 80 is provided and is pivotally connected to the body 50. The cover has a generally rounded top with flanges at the front and rear. A gasket of any suitable type can be provided for creating a seal between the cover 80 and body 50 so feed cannot escape the mill 5 during operation. The cover 90 has fins 81 on the inside portion. The fins 81 assist in defining a path 200 through the mill, by directing the feed longitudinally through the mill as the feed rotates under direction of the drum (described below).

Stands 90 and 95 are provided, and are preferably adjustable relative the body 50 in order to accommodate the mill height specifications of the user.

Figure 7:
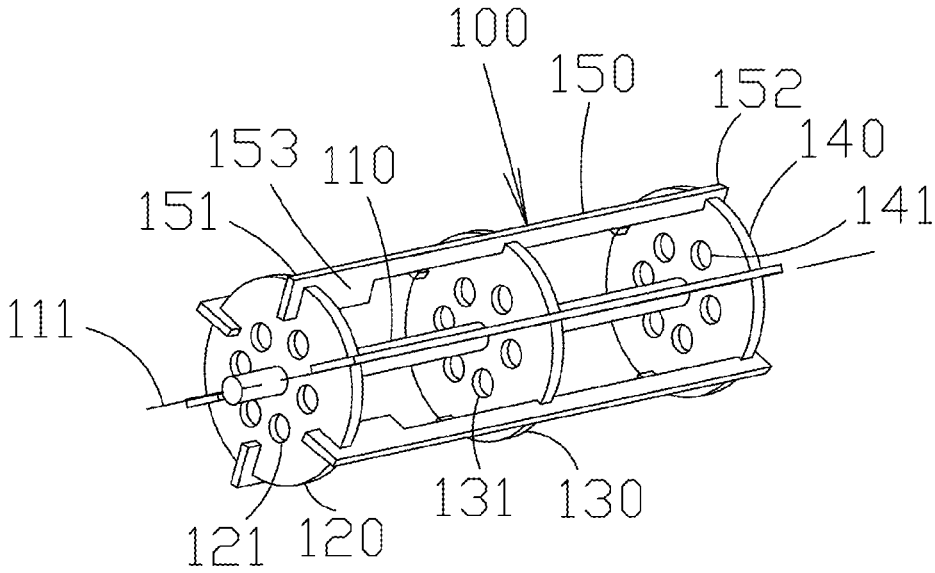
FIG. 7 is an isolation perspective view of a preferred drum.

A drum 100 is provided, and is seen in isolation in FIG. 7. The drum 100 has a central shaft 110 with a longitudinal axis 111. Three discs 120, 130 and 140 are provided and are spaced longitudinally along the shaft 110. Disc 120 has a plurality of holes 121 radially spaced from the center of the disc. The holes are preferably equidistantly spaced, and preferably have a selected diameter. In the preferred embodiment, there are preferably six holes through the disc 120. The holes are air holes, which allow air and other items to pass there through to each side of the disc 120.

Likewise, disc 130 has holes 131 and disc 140 has holes 141. Several blades 150 are connected to and spaced about the perimeter of the discs. Each blade has opposed ends 151 and 152. End 152 is preferably at or near disc 140, and end 151 is at or near disc 120. Ears 153 are formed at the end 152 of the blade. The blades 150 are formed of a robust and rigid material, such as but not limited to steel.

The drum 100 rotates about the shaft 110 within the interior 51 of the housing 50 of the body 40 of the mill 5. As the drum 100 rotates, the blades 150 pass in close proximity to the bars 60.

Feed is introduced to the path 200 through the mill 5 through the hopper 20, wherein it first contacts the blades and bars. The fins 81 and discs 120, 130 and 140 assist in directing the feed to make several passes within the mill 5. Ultimately, the feed leaves the housing through the outlet 52. The ears 153 on the rotating blades 150 assist in expelling the ground feed from the mill. The tabs 70 and 75 also help in defining the path 200.

Thus it is apparent that there has been provided, in accordance with the invention, an improved mill that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A mill comprising:

a housing having an inlet, an outlet, a housing top and a housing bottom, said housing bottom having a generally round profile;

at least one bar fixed to said housing near said housing bottom;

a drum having at least one blade attached thereto, said drum spinning about an axis wherein said at least one blade comes into close proximity with said at least one bar during revolution of said drum, wherein said at least one bar comprises at least one bar having a bend whereby said at least one bar is generally V shaped.

2. The mill of claim 1 wherein said at least one bar comprises four bars.

3. The mill of claim 1 wherein said at least one blade comprises a blade first end and a blade second, and further comprises an ear near said blade second end wherein said ear aids in directing an amount of feed to exit through said outlet.

4. The mill of claim 1 wherein said drum further comprises a plurality of discs.

5. The mill of claim 4 wherein said plurality of discs each have at least one air hole there through.

6. The mill of claim 1 wherein said housing further comprises a cover, said cover having at least one fin to aid in directing an amount of feed though said mill.

7. The mill of claim 1 further comprising a tab near said inlet, said tab being downwardly oriented.

8. A mill comprising:

a housing having an inlet, an outlet, a housing top and a housing bottom;

at least one bar fixed to said housing;

a drum having at least one blade attached thereto, said drum spinning about an axis wherein said at least one blade comes into close proximity with said at least one bar during revolution of said drum, said drum further having a plurality of discs positioned longitudinally along said axis, each of said plurality of discs having at least one air hole there through.

9. The mill of claim 8 wherein said at least one blade comprises a blade first end and a blade second, and further comprises an ear near said blade second end wherein said ear aids in directing an amount of feed to exit through said outlet.

10. The mill of claim 8 wherein:

said at least one bar comprises four bars, each of said four bars has a bend to define a V shaped bar; and said at least one blade comprises a plurality of blades equally spaced about said drum.

11. The mill of claim 8 wherein said plurality of discs comprises three discs.

12. The mill of claim 8 wherein said at least one air hole through each of said plurality of discs comprises six equally spaced air holes through each of said plurality of discs.

13. A mill comprising:

a housing having an inlet, an outlet, a housing top and a housing bottom, said housing bottom having a generally round profile;

at least one bar fixed to said housing near said housing bottom;

a drum having at least one blade attached thereto, said drum spinning about an axis wherein said at least one blade comes into close proximity with said at least one bar during revolution of said drum, wherein said at least one blade comprises a blade first end and a blade second, and further comprises an ear near said blade second end wherein said ear aids in directing an amount of feed to exit through said outlet.

14. A mill comprising:

a housing having an inlet, an outlet, a housing top and a housing bottom, said housing bottom having a generally round profile;

at least one bar fixed to said housing near said housing bottom;

a drum having at least one blade attached thereto, said drum spinning about an axis wherein said at least one blade comes into close proximity with said at least one bar during revolution of said drum, wherein said drum further comprises a plurality of discs; and wherein said plurality of discs each have at least one air hole there through.

* * * * *